United States Patent [19]

Whited

[11] 3,991,713

[45] Nov. 16, 1976

[54] DEVELOPMENT APPARATUS FOR AN ELECTROSTATOGRAPHIC PRINTING MACHINE

[75] Inventor: Charles A. Whited, Rochester, N.Y.

[73] Assignee: Xerox Corporation, Stamford, Conn.

[22] Filed: June 30, 1975

[21] Appl. No.: 591,582

Related U.S. Application Data

[62] Division of Ser. No. 444,089, Feb. 20, 1974, Pat. No. 3,926,516.

[52] U.S. Cl. ..... 118/637

[51] Int. Cl.[2] ..... G03G 15/09

[58] Field of Search..... 118/637; 427/18; 355/3 DD

[56] References Cited

UNITED STATES PATENTS

| | | | |
|---|---|---|---|
| 2,890,968 | 6/1959 | Giaimo | 427/18 |
| 3,117,884 | 1/1964 | Greig | 427/18 |
| 3,638,614 | 2/1972 | Young et al. | 118/637 |
| 3,641,980 | 2/1972 | Bickmore | 118/637 |
| 3,674,532 | 7/1972 | Morse | 118/637 |
| 3,788,275 | 1/1974 | Hanson | 118/637 |
| 3,866,564 | 2/1975 | Wilson | 118/637 |

*Primary Examiner*—Mervin Stein
*Assistant Examiner*—Douglas Salser
*Attorney, Agent, or Firm*—H. Fleischer; C. A. Green; J. J. Ralabate

[57] ABSTRACT

An apparatus which develops an electrostatic latent image with electrostatically charged particles. The apparatus produces a magnetic field which forms a brush-like array of charged particles. A development electrode is operatively associated with the magnetic field to suppress the effect of local contrast enhancement.

5 Claims, 3 Drawing Figures

DEVELOPMENT APPARATUS FOR AN ELECTROSTATOGRAPHIC PRINTING MACHINE

This is a division of application Ser. No. 444,089, filed Feb. 20, 1974, now U.S. Pat. No. 3,926,516.

The foregoing abstract is neither intended to define the invention disclosed in the specification, nor is it intended to be limiting as to the scope of the invention in any way.

BACKGROUND OF THE INVENTION

This invention relates generally to an electrostatographic printing machine, and more particularly concerns an improved development system for use therein.

The process of electrostatographic printing includes both electrographic printing and electrophotographic printing. In both of the foregoing processes an electrostatic charge pattern or latent image corresponding to the original document being reproduced is recorded on an image bearing member. Electrophotographic printing is disclosed in U.S. Pat. No. 2,297,691 issued to Carlson in 1942. As described therein, a photosensitive element having a photoconductive insulating layer is charged to a substantially uniform potential. The charged photoconductive surface is then exposed to a light image of the original document. The light image selectively dissipates the charge in the irradiated areas and creates an electrostatic latent image on the photoconductive surface. Electrographic printing creates an electrostatic latent image, without the employment of a photosensitive material or a light image.

While the foregoing processes form an electrostatic latent image in differing manners, the latent image is usually developed by bringing a developer mix into contact therewith. A typical developer mix generally comprises toner particles, such as colored thermoplastic particles, which electrostatically adhere to coarser carrier granules, such as ferromagnetic granules. The toner particles are usually heat settable.

Various types of developing systems are employed in the art. These systems include, amongst others, cascade development, magnetic brush development, powder cloud development and liquid development. Magnetic brush systems achieve a high degree of uniform deposition and, therefore, numerous electrostatographic printing machines employ this type of system.

Multi-color electrostatographic printing involves the utilization of various process components to produce a series of electrostatic latent images corresponding to a particular color in the original document. In such a system, there is a requirement to develop successive partial color images. Each color image is developed with toner particles of a selected color. These powder images are then transferred to a suitable support surface, in registration with one another, to form a reproduction of the colored original document.

In magnetic brush systems, frequently the local contrast in the developed image is extremely high. Development systems frequently produce a powder cloud or quantity of toner particles disposed in the region of the development zone. Heretofore, the foregoing powder cloud was treated as an undesirable effect and measures were generally taken to suppress the formation thereof. However, it has now been found that the hereinbefore unwanted powder cloud may be employed to suppress the effects of local contrast.

Accordingly, it is a primary object of the present invention to improve the apparatus employed in developing electrostatic latent images so as to suppress the effects of local contrast and produce a softer or less harsh copy.

SUMMARY OF THE INVENTION

Briefly stated and in accordance with the present invention, there is provided an apparatus for developing an electrostatic latent image with electrostatically charged particles.

This is achieved by the apparatus of the present invention which includes magnetic field producing means and development electrode means. In operation, the magnetic field producing means is positioned closely adjacent to the latent image. The magnetic field producing means forms a brush-like array of charged particles contacting the latent image. Operatively associated with the magnetic field producing means is development electrode means. The development electrode means is closely spaced to the latent image so as to suppress the effects of local contrast.

BRIEF DESCRIPTION OF THE DRAWINGS

Other objects and advantages of the present invention will become apparent upon reading the following detailed description and upon reference to the drawings in which.

While the present invention will hereinafter be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
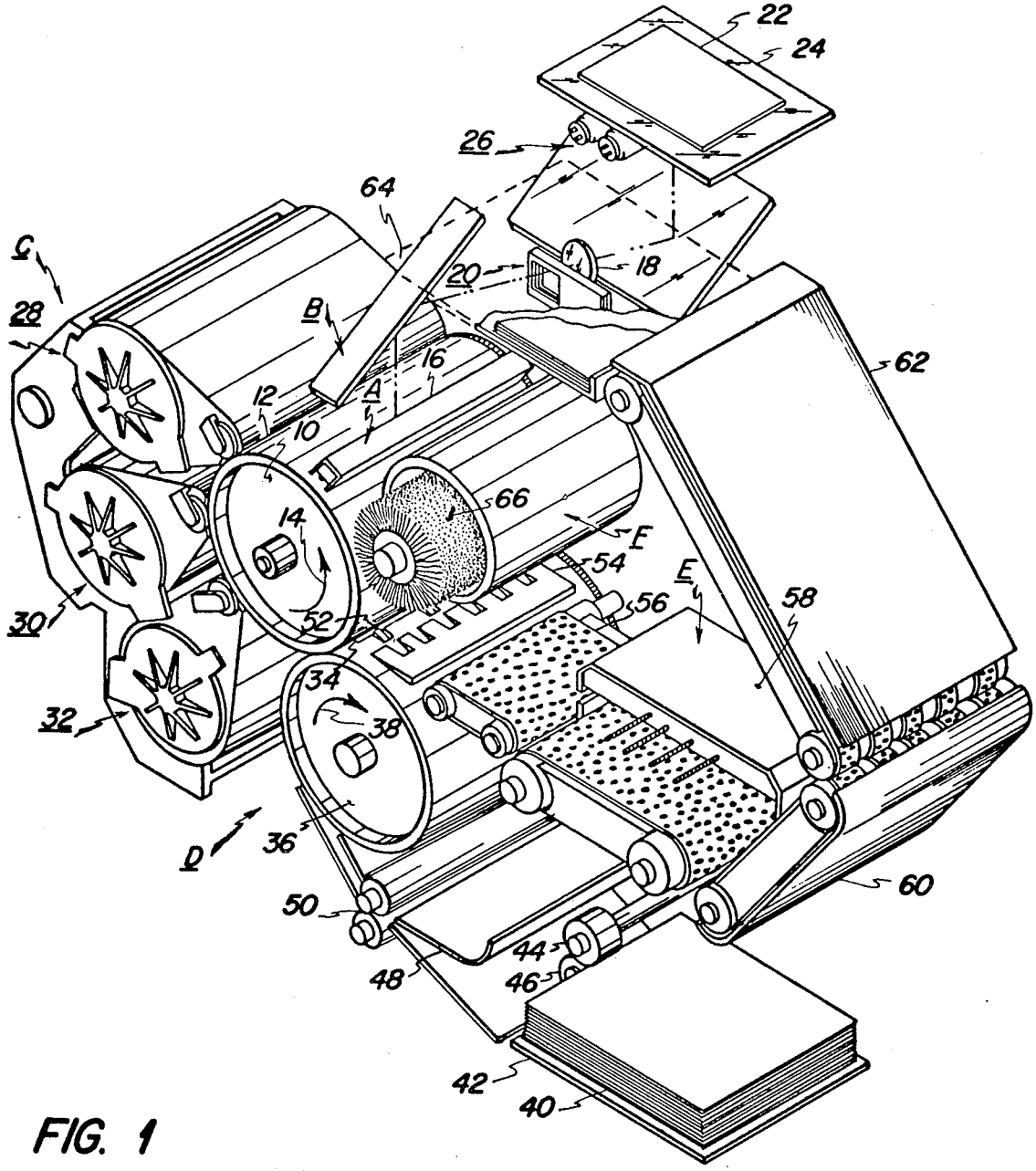
FIG. 1 is a schematic perspective view of a color electrophotographic printing machine incorporating the features of the present invention therein.

For a general understanding of the illustrated electrophotographic printing machine, in which the present invention may be incorporated, reference is had to the drawings wherein like reference numerals have been used throughout to designate like elements. FIG. 1 schematically illustrates the various components of a printing machine arranged to produce color copies from a colored original document. As in all electrophotographic printing machines of the type illustrated, a light image of a document to be reproduced is projected onto a sensitized photoconductive surface to form an electrostatic latent image thereon. The latent image is developed with toner particles forming a powder image thereof. Subsequently, the powder image is transferred to a sheet of support material and affixed permanently thereto forming a copy of the original document.

Turning now to FIG. 1, the printing machine employs a rotatably mounted drum 10 having a photoconductive surface 12 entrained about and secured to the circumferential surface thereof. Photoconductive surface 12, preferably, is formed of a material having a relatively panchromatic response to light of all colors. A suitable photoconductive material is described in U.S. Pat. No. 3,655,377 issued to Sechak in 1972. Drum 10 is driven at a predetermined speed relative to the other machine operating mechanisms and rotates in the direction of arrow 14 to move photoconductive surface 12 sequentially through a series of processing stations. A timing disc (not shown) rotating with drum 10, is adapted to initiate the sequence of events at the various processing stations as photoconductive surface 12 of drum 10 passes therethrough.

First, photoconductive surface 12 moves through charging station A which has positioned thereat a corona generating device, indicated generally at 16. Corona generating device 16 extends longitudinally across photoconductive surface 12. This readily enables corona generating device 16 to charge photoconductive surface 12 to a relatively high substantially uniform potential. Preferably, corona generating device 16 is of a type described in U.S. Pat. No. 2,778,946 issued to Mayo in 1957.

After photoconductive surface 12 is charged to a substantially uniform level, drum 10 is rotated to exposure station B. Exposure station B includes a moving lens system, generally designated by the reference numeral 18, and a color filter mechanism, shown generally at 20. An original document 22, such as a sheet of paper, book or the like, is stationarily supported upon transparent viewing platen 24 wherein successive incremental areas thereof are illuminated by means of a moving lamp assembly 26. Lens system 18 is adapted to focus the light rays reflected from original 22 to form a light image which is projected onto photoconductive surface 12. Lamp assembly 26 and lens system 18 moves in a timed relationship with respect to drum 10 to project a non-distorted light image of the original document onto photoconductive surface 12. During exposure, filter mechanism 20 interposes a selected color filter into the optical light path of lens 18. The color filter operates on the light image passing through lens 18 to record an electrostatic latent image on photoconductive surface 12 corresponding to a specific color of the light image. A suitable moving lens system is described in U.S. Pat. No. 3,062,108 issued to Mayo in 1962, and a suitable color filter mechanism as described in U.S. Pat. No. 3,775,006 issued to Hartman et al. in 1973. The electrostatic latent image recorded on photoconductive surface 12 corresponding to a preselected spectral region of the electromagnetic wave spectrum will hereinafter be referred to as a single color electrostatic latent image.

After the electrostatic latent image is recorded on photoconductive surface 12, drum 10 is rotated to development station C. Development station C includes three individual developer units generally indicated by the reference numerals 28, 30 and 32, respectively. Each of the developer units are of a type hereinbefore referred to as magnetic brush development systems. In a magnetic brush development system, a magnetizable developer mix having carrier granules and toner particles is continually brought through a directional flux field to form a brush-like array of developer material. The developer mix is continually moving to provide a fresh supply to the brush. In the magnetic brush system, a mass of developer mix adheres magnetically to a magnetic member. The developer mix includes carrier granules having toner particles clinging thereto by triboelectric attraction. This chain-like arrangement of developer mix simulates the fibers of the brush. Development is achieved by bringing the developer mix brush into contact with photoconductive surface 12. Each of the developer units 28, 30 and 32, respectively, have a pair of development electrodes associated therewith. The development electrodes are adapted to enhance the development of the leading and trailing edges of the electrostatic latent image. A detailed discussion of the developer unit's structural configuration will be found hereinafter with reference to FIGS. 2 and 3. It should be noted that each of the developer units 28, 30 and 32, respectively, apply tone particles adapted to absorb light within a preselected spectral region of the electromagnetic wave spectrum corresponding to the wave length of light transmitted through the filter. For example, a latent image formed by passing the light image through a green filter will record the red and blue portions of the spectrum as areas of relatively high charge density on photoconductive surface 12, while the green light rays will pass through the filter and cause the charge density on photoconductive surface 12 to be reduced to a voltage level ineffective for development. The charged areas are then made visible by applying green absorbing (magenta) toner particles to the latent image recorded on photoconductive surface 12. Similarly, a blue separation is achieved with blue absorbing (yellow) toner particles, while a red separation is developed with red absorbing (cyan) toner particles.

After development, the now visible image is moved to transfer station D where the powder image is transferred to a sheet of final support material 34, such as plain paper amongst others. Transfer is achieved by a transfer roll, shown generally at 36. The surface of transfer roll 36 is electrically biased to a potential having a magnitude and polarity sufficient to electrostatically attract toner particles from photoconductive surface 12 to support sheet 34. Transfer roll 36 is adapted to secure releasably thereto a single sheet of support material 34 for movement therewith in a recirculating path. The transfer roll is arranged to move in synchronism with photoconductive surface 12. To this end, transfer roll 36 rotates in the direction of arrow 38 at about the same angular velocity as drum 10, and is about the same diameter as drum 10. In this manner, successive powder images are transferred to support material 34 in superimposed registration with one another. The aforementioned steps of charging the photoconductive surface, exposing the photoconductive surface to a specific color of the flowing light image of the original document, developing the electrostatic latent image recorded on the photoconductive surface with appropriately colored toner particles and transferring the single colored toner powder image to the sheet of support material are repeated a plurality of cycles to form a color copy of the original document on the support sheet. U.S. Pat. No. 3,612,677 issued to Langdon et al. in 1972 describes a suitable electrically biased transfer roll.

With continued reference to FIG. 1, the path for advancing support material 34 to transfer roll 36 will be briefly described. Support material 34 is disposed as a stack 40 on tray 42. Feed roll 44 operatively associated with retard roll 46 separates and advances the uppermost sheet from stack 40. The advancing sheet then moves into a chute 48 which directs it into the nip of register rolls 50. Next, gripper fingers 52, mounted on transfer roll 36, releasbly secure support material 34 thereto for movement therewith in a recirculating path.

Continuing now with the printing process, after all of the discretely colored toner powder images have been transferred to support material 34, gripper fingers 62 space support material 34 from transfer roll 36. This permits stripper bar 54 to be interposed therebetween so as to separate support material 34 from transfer roll 36. Support material 34 is then positioned on endless belt conveyor 56 which advances it to fixing station E.

At fixing station E, a suitable fuser, indicated generally at 58, permanently affixes the transferred toner powder image to support material 34. A typical fuser is described in U.S. Pat. No. 3,498,592 issued to Moser et al. in 1970. This type of fuser applies heat to the toner powder image so as to permanently set and fix it to support material 34. After the multi-layered toner powder image is fused, support material 34 is advanced by endless belt conveyors 60 and 62 to catch tray 64. At catch tray 64, the machine operator is capable of removing the final color copy from the printing machine.

The final processing station in the direction of rotation of drum 10 is cleaning station F. Although a preponderance of the toner particles are transferred to support material 34, invariably some residual toner particles remain on photoconductive surface 12. Preferably, a brush 66 is positioned in contact with photoconductive surface 12 at cleaning station F to remove the residual toner particles from photoconductive surface 12. One type of suitable brush cleaning device in described in U.S. Pat. No. 3,590,412 issued to Gerbasi in 1971. Prior to removing residual toner particles with brush 66, a corona generating device (not shown) neutralizes the electrostatic charge remaining on the toner particles and that of photoconductive surface 12. This more readily enables brush 66 to remove the residual toner particles from photoconductive surface 12.

It is believed that the foregoing description is sufficient for purposes of the present invention to illustrate the general operation of a color electrophotographic printing machine embodying therein the development system of the present invention.

Figure 2:
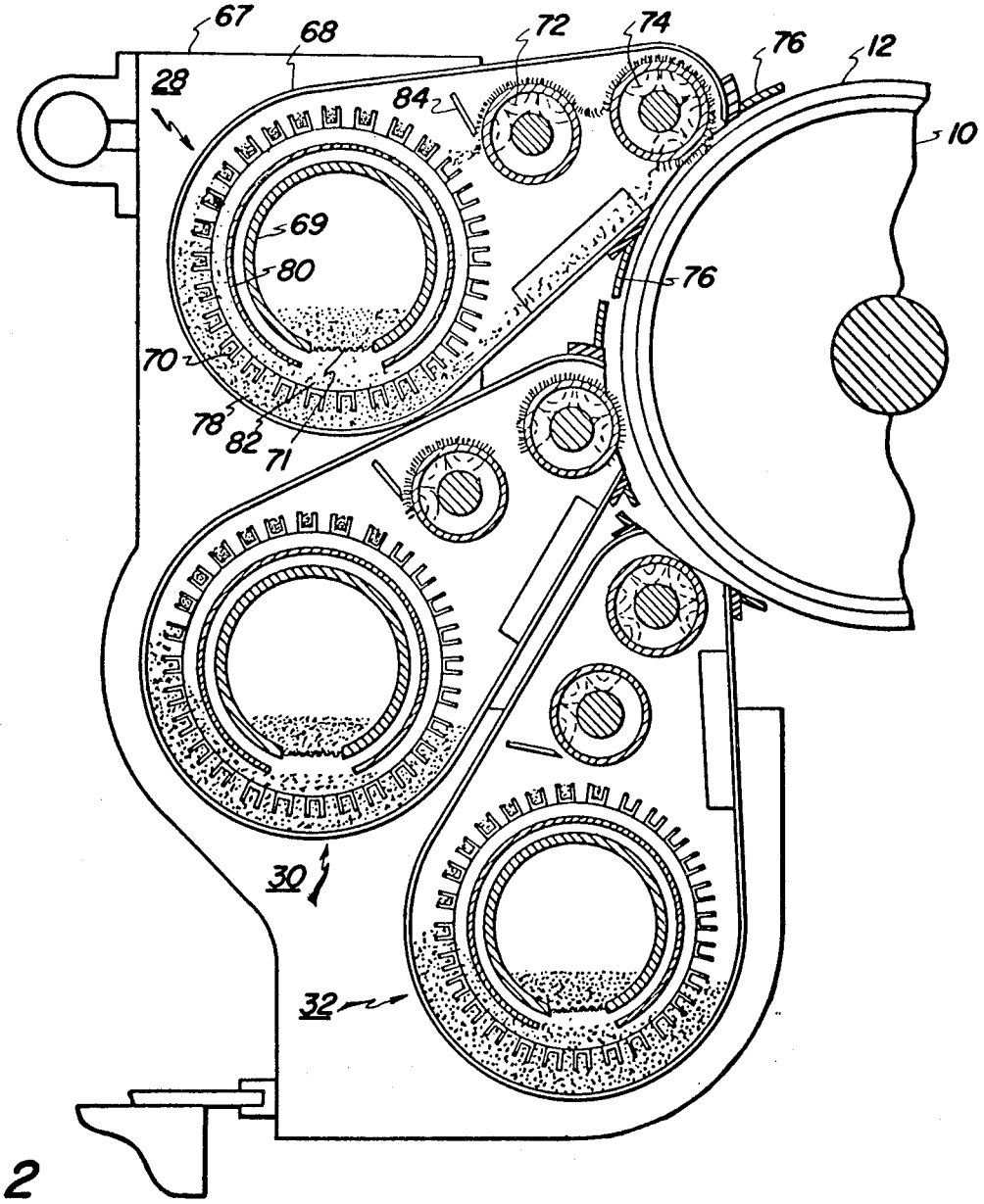
FIG. 2 is a sectional elevational view of the development system of the present invention employed in the FIG. 1 printing machine.

Turning now to the subject matter of the present invention, FIG. 2 shows a multi-color development system. The development system includes a frame 67 mounted in the printing machine and supporting three developer units 28, 30 and 32, respectively. These developer units are depicted in an elevational sectional view to indicate more clearly the various components included therein. For purposes of explanation, developer unit 28 will only be discussed in detail, as developer units 30 and 32 are nearly identical thereto. The distinction between each of the developer units is the color of the toner particles contained therein and minor geometrical differences due to the mounting angle. Developer unit 28 may have yellow toner particles therein, unit 30 magenta toner particles, and unit 32 cyan toner particles although different color combinations may also be employed. It should be noted that the basic features exclusive of the development electrodes of the respective developer units 28, 30 and 32 are described in detail in co-pending application Ser. No. 255,259 filed in 1972, the disclosure of which is hereby incorporated into the present application.

The principle components of developer unit 28 are developer housing 68, paddle wheel 70, transport roll 72, developer roll 74 and a pair of development electrodes 76. Paddle wheel 70 is a cylindrical member having buckets or scoops around the periphery thereof and being adapted to rotate so as to elevate developer mix 78 from the lower region of housing 68 to the upper region thereof. When developer mix 78 reaches the upper region of housing 68, it is lifted from the paddle wheel buckets to transport roll 72. Alternate buckets of paddle wheel 70 have apertures in the root diameter so that the developer mix in these areas is not carried to transport roll 72, but, instead, falls back to the lower region of developer housing 68. As the developer mix falls back to the lower region of developer housing 68, it cascades over shroud 80 which is of a tubular configuration with aperture 82 in the lower region thereof. Developer mix 78 is recirculated in this manner so that the carrier granules are continually agitated to mix with fresh toner particles. This generates a strong triboelectric charge between the carrier granules and toner particles. As developer mix 78, in the paddle wheel buckets, approaches transport roll 72, the magnetic fields produced by the fixed magnets therein attract developer mix 78 thereto. Transport roll 72 moves developer mix 78 in an upwardly direction by the frictional force exerted by the roll surface and developer mix. A surplus of developer mix is furnished and metering blade 84 is provided to control the amount of developer mix carried over the top of transport roll 72. Surplus developer mix 78 is sheared from transport roll 72 and falls in a downwardly direction toward paddle wheel 70. As the surplus developer mix descends, it falls through the apertures of paddle wheel 70 in a downwardly direction into the lower region of developer housing 68. Developer mix which passes metering blade 84 is carried over transport roll 72 to developer roll 74 and into development zone 98 located between photoconductive surface 12 and developer roll 74. The developer mix adhering to developer roll 74 forms a brush-like array which is positioned in contact with photoconductive surface 12. In addition thereto, a powder cloud or quantity of toner particles is formed in the space therebetween. Development electrodes 76 utilize this powder cloud to suppress the effects of local contrast in the development of the elctrostatic latent image recorded on photoconductive surface 12. Development electrodes 76 are positioned before and after developer roll 74 being secured to developer housing 68. Development electrodes 76 are electrically biased to a potential somewhat greater than the background voltage of the latent image. The preferred electrical biasing voltage will depend upon the spacing between the photoconductive surface and the development electrode. This spacing may range from about 0.010 inches to about 0.060 inches. An alternate embodiment of the present invention would provide for adjustable development electrodes so that the spacing and electrical bias may be optimized to match the characteristics of the original document, i.e. fine detail or large areas devoid of detail. This may be achieved by having slots in the development electrodes. A fastener or clamp passes through this slot and is in threaded engagement with the developer housing. This slot is substantially normal to the photoconductive surface. In this manner, the development electrodes may be positioned relative to the photoconductive surface, i.e. the gap therebetween may be adjusted. Thus, development will occur in all regions having a potential greater than that of the electrical bias applied to the development electrodes. In this manner, the heretofore extraneous powder cloud is employed to suppress local contrast effects.

Additional toner particles are furnished to developer mix 78 from toner storage container 69. Toner container 69 has a screen 71 disposed in the lower region thereof. A suitable motor (not shown) oscillates container 69 to dispense a prescribed amount of toner particles to developer mix 78. In this fashion, the concentration of toner particles within developer mix 78 is maintained substantially constant. A detailed description of the toner storage container is in co-pending application Ser. No. 266,875 filed in 1972, the disclosure of which is hereby incorporated into the present application.

Figure 3:
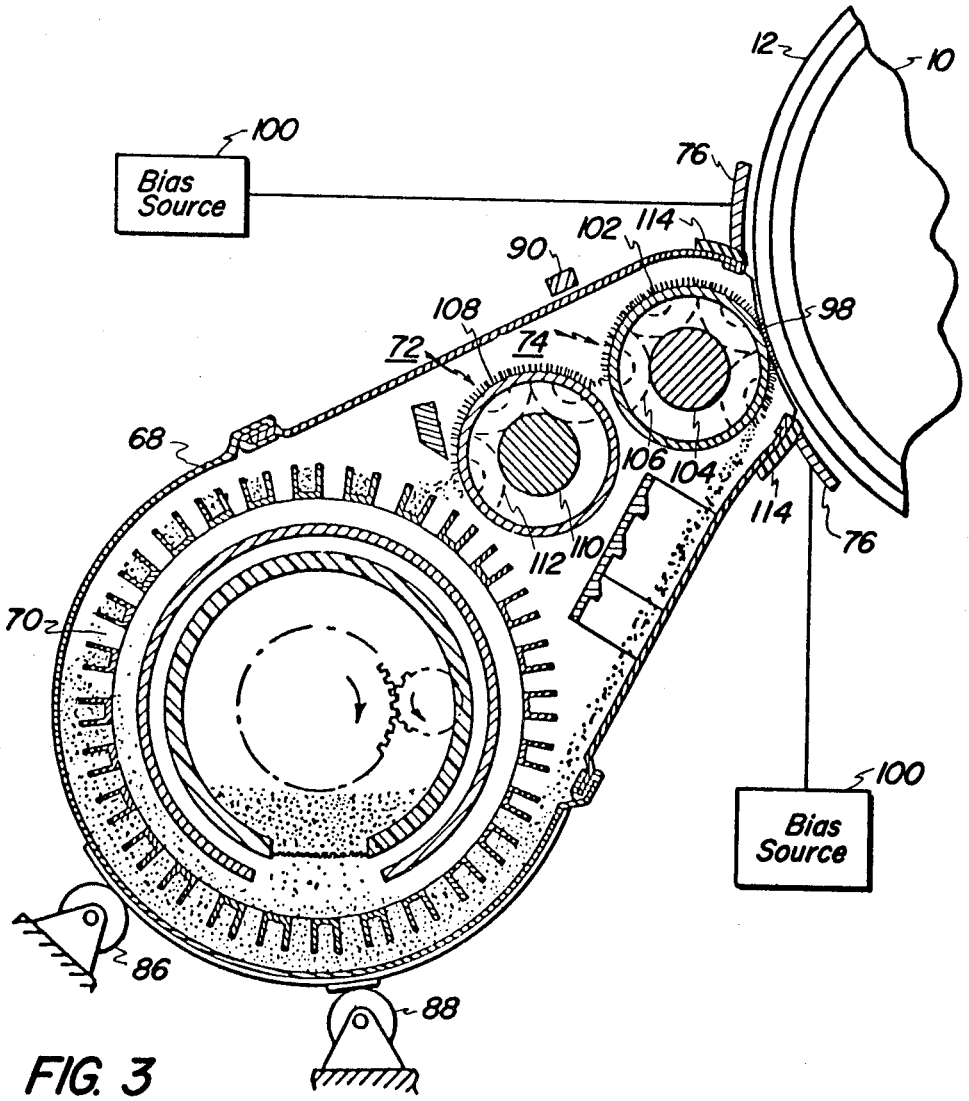
FIG. 3 is a fragmentary, sectional elevational view depicting, in detail, one of the FIG. 2 developer units.

Turning now to FIG. 3, the operation of developer unit 28 will be discussed in greater detail. Developer housing 68 is pivoted about the center of paddle wheel 70 and is supported at the lower region of the exterior surface thereof by rollers 86 and 88 mounted rotatably in frame 67. A spring (not shown) pivots developer housing 68 against stop 90. In this position, developer roll 74 is in the non-operative position spaced from photoconductive surface 12. Operation begins when clutch gear 92 meshes with gear 94 which is attached to paddle wheel 68, thereby causing paddle wheel 68 to revolve clockwise as indicated by arrow 96. As gear 94 and paddle wheel 68 start to rotate, a reaction torque is exerted against developer housing 68 due to the resistance to motion of developer mix 78 which fills developer housing 68. This reaction torque causes housing 68 to rotate clockwise against the force of the spring until a stop, a wheel (not shown) is positioned against drum 10. Rolls 72 and 74 are rotated in conjunction with paddle wheel 68 by a gear train (not shown). Once the latent image recorded on photoconductive drum 10 has passed development zone 98 which extends from the end of one of the development electrodes 76 to the end of the other development electrode 76, development action is discontinued. Hereinbefore, development action would only occur in the region of developer roll 74. However, in the present invention, development action continues substantially throughout the length of the development electrode 76. It should be noted that development may not occur along the entire length of the electrodes, but may only occur in the vicinity of developer roll 74. The region of development under electrodes 76 will depend upon how far the powder cloud extends under development electrodes 76. After development has discontinued the drive motor is disconnected from gear 92 by de-energizing the clutch leaving gear 92 to rotate freely. Paddle wheel 68, developer roll 72 and transport roll 74 now stop rotating. This causes the spring to pivot developer housing 68 counterclockwise until it engages stop 90 in its inoperative position. This completes the development cycle for one of the developer units. It should be noted that power supplies 100 are provided to electrically bias electrodes 76. Power supply 100 biases electrode 76 to a potential ranging from about 100 to about 500 volts. The developer bias will depend upon the spacing between the electrodes and the photoconductive surface. As shown in FIG. 3, two power supplies are provided, one for each development electrode. However, one skilled in the art will appreciate that two power supplies are not necessarily required. One power supply may be employed instead of the two shown in FIG. 3. The aforementioned procedure has been described for developer unit 28. This procedure is repeated for developer units 30 and 32.

In the preferred embodiment thereof, developer roll 74 includes a non-magnetic tubular member 102, preferably made from an aluminum tube having an irregular or roughened exterior surface. Tubular member 102 is mounted rotatably on shaft 104 by ball bearings. Shaft 104 made, preferably, from stainless steel, is mounted within tubular member 102 and also serves as a fixed mounting for magnets 106. Magnets 106, preferably, are made from barium ferrite in the form of annular rings and are arranged to have five poles in a 284° arc about shaft 104.

Similarly, transport roll 72 includes a non-magnetic tubular member 108, also, preferably made from an aluminum tube having an irregular or roughened exterior surface. Tubular member 108 is journaled for rotation relative to shaft 110 and is secured rotatably thereon by ball bearings. Shaft 110, preferably, is made of steel and mounted concentrically within tubular member 108 to function as a fixed mounting for magnets 112. Magnets 112, preferably, are made from barium ferrite in the form of annular rings arranged to have four poles in a 180° arc about shaft 110. Each of the developer units 28, 30 and 32, respectively, is actuated by the timing disc (not shown) mounted on the shaft of drum 10. The timing disc is opaque with a plurality of spaced slots in the circumferential periphery thereof. The timing disc is interposed between an illuminating source and a photosensor to generate an electrical signal as each slot permits light rays to pass through the disc. The electrical signal, in association with a suitable machine logic control system, activates the appropriate developer unit.

By way of example, development electrodes 76 are arcuate sheet-like baffles or plates extending, in the operative position, substantially parallel to and closely spaced from photoconductive surface 12. The development electrode plates extend in a lengthwise direction across substantially the entire surface of drum 10. A non-conductive member or insulating strip 114 is secured to developer housing 68. Each plate 76 is mounted on a non-conductive member 114 so as to be insulated from developer housing 68 when developer housing 68 is made from a conductive material such as an aluminum structure. Nonconductive members 114 are preferably made from Teflon or any other suitable plastic insulating material. These nonconductive members are secured to developer housing 68 by suitable means such as cement or fasteners. Similarly, development electrodes 76 are secured to non-conductive member 114 by suitable means such as cement or suitable fasteners.

From the foregoing it is apparent that the development system of the present invention improves copies produced in an electrostatographic printing machine by utilizing for development the hereinbefore non-used powder cloud. This is achieved by combining a magnetic brush with a development electrode so as to suppress the effects of local contrast enhancement. Moreover, the system is designed to be moved into and out of operative association with the respective electrostatic latent image permitting successive single color toner powder images to be developed on the photoconductive surface and, substantially thereto, transferred in registration with one another, to a support sheet producing a multi-color copy of the colored original document.

It is therefore evident that there has been provided in accordance with the present invention an apparatus for developing an electrostatic latent image that fully satisfies the objects, aims and advantages set forth above. While this invention has been described in conjunction with specific embodiments thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. An apparatus for developing an electrostatic latent image with electrostatically charged particles, including:

a developer housing defining a chamber for storing electrostatically charged particles;

a tubular member of non-magnetic material journaled for rotary movement in said developer housing;

a magnetic member fixedly disposed within said tubular member for creating a magnetic field in the path of the periphery of said tubular member to form a brush-like array of charged particles on said tubular member; and at least one conductive plate closely spaced to the electrostatic latent image to suppress the effects of local contrast enhancement said conductive plate being mounted movably on said developer housing so that the space between said conductive plate and the latent image may be substantially optimized.

2. An apparatus as recited in claim 1, further including means for moving said developer housing from an inoperative position wherein the brush-like array of charged particles formed on said tubular member is spaced from the latent image to an operative position wherein the brush-like array of charged particles formed on said tubular member contacts the latent image.

3. An apparatus as recited in claim 1, further including means for electrically biasing said conductive plate.

4. An apparatus for developing an electrostatic latent image with electrostatically charged particles, including:

a developer housing defining a chamber for storing the electrostatically charged particles;

magnetic field producing means mounted in the chamber of said developer housing and operatively positioned closely adjacent to the latent image forming a brush-like array of charged particles in brushing contact with the latent image; and at least one conductive plate mounted on said developer housing and extending outwardly therefrom, said conductive plate being operatively positioned closely adjacent to the latent image.

5. An apparatus as recited in claim 4, wherein said magnetic field producing means includes:

a tubular member of non-magnetic material journaled for rotary movement in said developer housing; and a magnetic member fixedly disposed within said tubular member for creating a magnetic field in the path of the periphery of said tubular member.

* * * * *